US005400229A

United States Patent [19]

Lin

[11] Patent Number: 5,400,229

[45] Date of Patent: Mar. 21, 1995

[54] RECEPTACLE APPARATUS FOR LIGHT EMITTING DIODES

[75] Inventor: Sharming Lin, Taipei, Taiwan, Prov. of China

[73] Assignee: Formosa Industrial Computing, Inc., Taipei, Taiwan, Prov. of China

[21] Appl. No.: 257,017

[22] Filed: Jun. 8, 1994

[51] Int. Cl.[6] ..... F21V 19/00

[52] U.S. Cl. ..... 362/249; 362/800

[58] Field of Search ..... 362/238, 249, 800; 313/500

[56] References Cited

U.S. PATENT DOCUMENTS

| | | | |
|---|---|---|---|
| 5,038,255 | 8/1991 | Nishihashi et al. | 362/800 |
| 5,119,279 | 6/1992 | Makowsky | 362/800 |
| 5,122,939 | 6/1992 | Kazdan et al. | 362/800 |
| 5,161,882 | 11/1992 | Garrett | 362/249 |
| 5,268,828 | 12/1993 | Miura | 362/800 |

*Primary Examiner*—Ira S. Lazarus
*Assistant Examiner*—L. Heyman
*Attorney, Agent, or Firm*—Parkhurst, Wendel & Rossi

[57] ABSTRACT

A receptacle for light emitting diodes includes a housing defining an opening at one end and having a bottom at another end; a first positioning device being a disk adapted to be received in substantially a middle inner periphery of the housing, defining a plurality of holes each of which receives a corresponding light emitting diode; and a second positioning device being a disk including a plurality of holes each of which encloses a head portion of a corresponding one of the light emitting diodes, thereby retaining an axis of each light emitting diode in a same direction.

2 Claims, 2 Drawing Sheets

RECEPTACLE APPARATUS FOR LIGHT EMITTING DIODES

BACKGROUND OF THE INVENTION

1. Field of the Invention

The present invention relates to a receptacle apparatus for light emitting diodes, especially one which receives and retains a plurality of light emitting diodes (LEDs) in parallel with each other.

2. Description of the Prior Art

LED-type displaying boards are commonly used in advertising fields and each LED-type displaying board comprises a plurality of receptacles each of which comprises a plurality of LEDs installed thereon. FIG. 3 illustrates a conventional LED receptacle which includes a barrel-type housing 50 defining an opening 51 at one end and having a bottom at another end, a circuit board 80 adapted to be received i substantiall a middle inner periphery of the barrel-type housing 50, a plurality of LEDs 70 fixed at a plurality of apertures 81 of the-circuit board 80 and extending from one surface thereof. The LEDs 70 are secured to the circuit board 80 by soldering two pins thereto, therefore the LEDs 70 are apt to slant due to manual contact in assembling, thus causing multi-directional light projection of the LEDs 70 and decreasing the illumination from the LED receptacle. It is requisite to provide a new receptacle for retaining the LEDs in parallel with each other therefore the LEDs can provide a unidirectional light projection, thereby increasing the illumination efficiency.

SUMMARY OF THE INVENTION

The primary objective of the present invention is to provide a receptacle apparatus for light emitting diodes, which can receive and retain a plurality of light emitting diodes in parallel with each other, thus increasing illumination of the LED receptacle.

In accordance with one aspect of the invention, there is provided a receptacle for light emitting diodes comprising a barrel-type housing defining an opening at one end and having a bottom at another end; a first positioning device being a disk adapted to be received in substantially a middle inner periphery of the barrel-type housing, defining a plurality of holes each of which receives a corresponding light emitting diode; and a second positioning device being a disk including a plurality of holes each of which encloses a head portion of a corresponding one of the light emitting diodes, thereby retaining an axis of each light emitting diode in a same direction.

DETAILED DESCRIPTION OF THE PREFERRED EMBODIMENT

Figure 1:
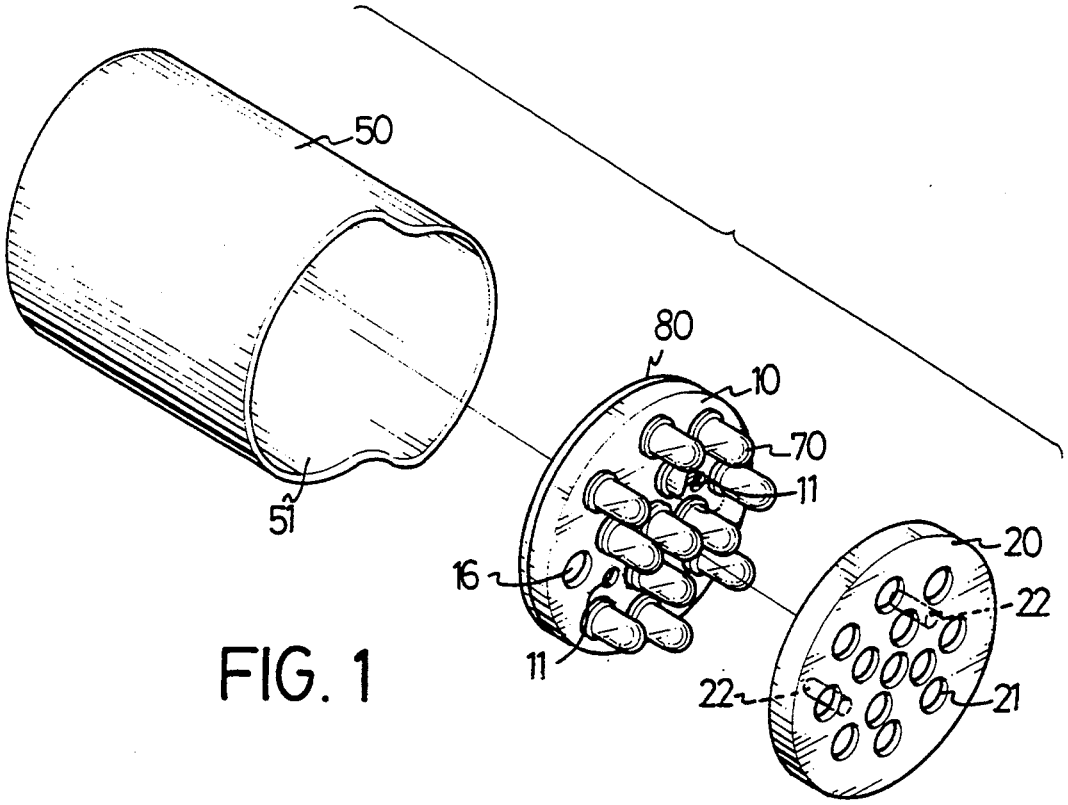
FIG. 1 is an exploded view of an improved receptacle for light emitting diodes.
Figure 2:
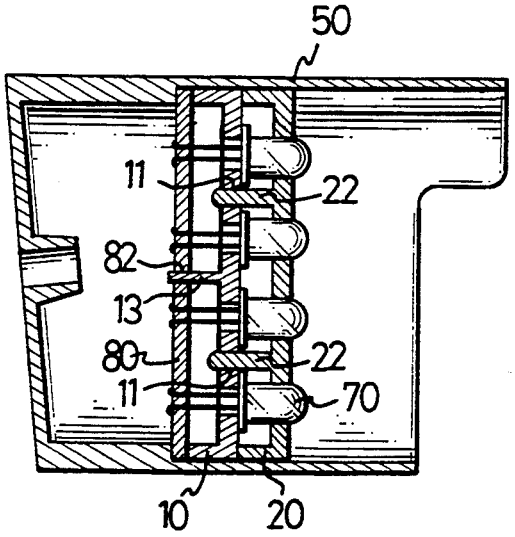
FIG. 2 is a cross-sectional view of the receptacle apparatus of FIG. 1.
Figure 3:
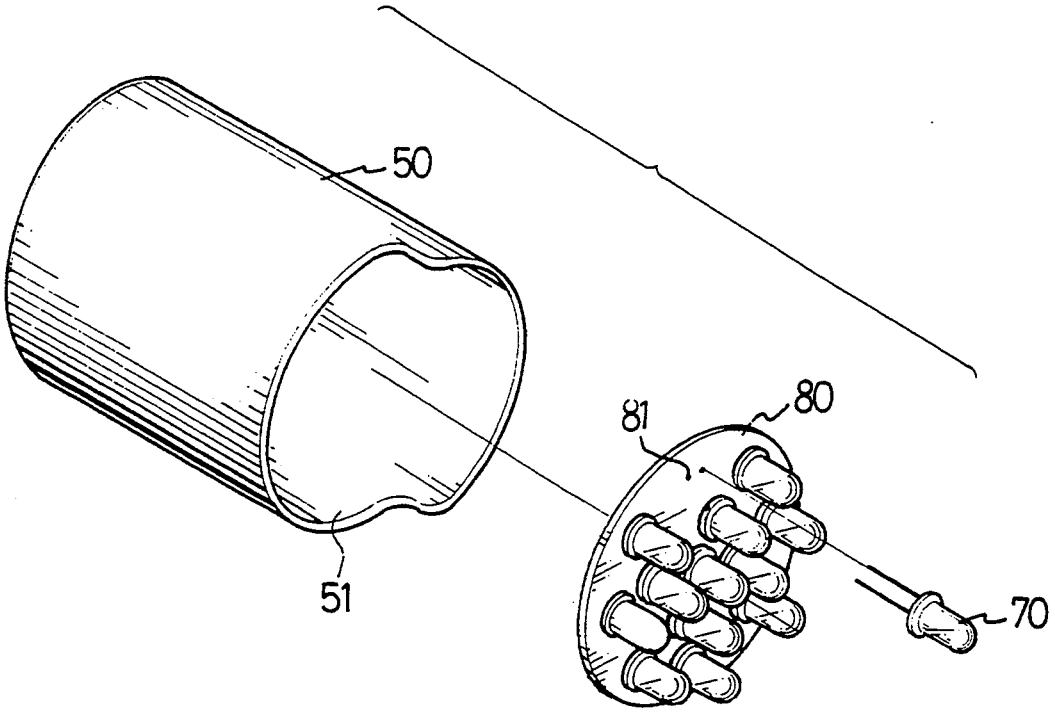
FIG. 3 PRIOR ART
FIG. 3 is an exploded view of a conventional receptacle for light emitting diodes.

Referring to the drawings and initially to FIGS. 1 and 2, a receptacle for light emitting diodes in accordance with the present invention comprises the conventional receptacle of FIG. 3 including the barrel-type housing 50 and the circuit board 80, a first positioning device 10 and a second positioning device 20. Similar to the conventional one, the receptacle of the present invention comprises a barrel-type housing 50 defining an opening 51 at one end and having a bottom at another end. The first positioning device 10 is a disk adapted to be received in substantially a middle inner periphery of the barrel-type housing 50. A plurality of holes 16 are defined extending through a bottom of the first positioning device 10. Two posts 13 extending from the bottom of the first positioning device 10 are each received in a corresponding apertures 82 of the circuit board 80.

A plurality of light emitting diodes (LEDs) 70 are each fixed at a corresponding hole 16 of the first positioning device 10 with two pins thereof passing through the hole 16 and being soldered on the circuit board 80. The first positioning device 10 additionally defines two apertures 11. Similar to the first positioning device 10, the second positioning device 20 is a disk defining a plurality of holes 21 extending through a bottom thereof. Each hole 21 encloses a head portion of a corresponding one of the LEDs 70, thereby retaining an axis of each LED 70 in a same direction when the second positioning device 20 is mounted on the first positioning device 10. Two posts 22 extending from the second positioning device 20 are inserted into the two apertures 11 of the first positioning device 10 thus securing the second positioning device 20 to the first positioning device 10.

I claim:

1. A receptacle for light emitting diodes comprising:

a housing defining an opening at one end and having a bottom at another end;

a first positioning device being a disk adapted to be received in substantially a middle inner periphery of the housing defining a plurality of holes each of which receives a corresponding light emitting diode; and a second positioning device being a disk including a plurality of holes each of which encloses a head portion of a corresponding one of the light emitting diodes, thereby retaining an axis of each light emitting diode in a same direction.

2. A receptacle for light emitting diodes as claimed in claim 1 further comprising two posts extending from said second positioning device and two apertures defined in said first positioning device for receiving said posts thus engaging said second positioning device to said first positioning device.

* * * * *